United States Patent [19]

Kutsuwada et al.

[11] 4,288,514

[45] Sep. 8, 1981

[54] METHOD FOR CONTROLLING IMAGE FORMATION IN ELECTROPHOTOGRAPHY BY PRE-EXPOSURE STEP

[75] Inventors: Noboru Kutsuwada, Tokyo; Minoru Saito, Hachioji; Ryoichi Namiki, Hino; Katsuo Kusunoki, Machida, all of Japan

[73] Assignee: Canon Kabushiki Kaisha, Tokyo, Japan

[21] Appl. No.: 831,263

[22] Filed: Sep. 7, 1977

Related U.S. Application Data

[63] Continuation of Ser. No. 490,055, Jul. 19, 1974, abandoned, which is a continuation of Ser. No. 57,732, Jul. 23, 1970, abandoned.

[30] Foreign Application Priority Data

Jul. 28, 1969 [JP] Japan ..... 44-59014

[51] Int. Cl.[3] ..... G03G 13/22; G03G 13/24

[52] U.S. Cl. ..... 430/54; 430/55; 355/14 CH

[58] Field of Search ..... 96/1.4, 1 R, 3 R, 3 TR; 355/14; 430/67, 54, 55

[56] References Cited

U.S. PATENT DOCUMENTS

| | | | |
|---|---|---|---|
| 2,956,487 | 10/1960 | Giaimo | 355/14 |
| 3,146,100 | 8/1964 | Kaufman | 96/1 R |
| 3,249,430 | 5/1966 | Metcalfe et al. | 430/54 |
| 3,438,706 | 4/1969 | Tawaka | 96/1.4 |
| 3,457,070 | 7/1969 | Watanabe et al. | 96/1 R |
| 3,525,612 | 8/1970 | Holstead | 96/1 R |
| 3,533,783 | 10/1970 | Robinson | 96/1 R |
| 3,558,307 | 1/1971 | Carlson | 96/1 R |
| 3,655,369 | 4/1972 | Kinoshia | 96/1 R |
| 3,666,364 | 5/1972 | Marushima | 96/1 R |
| 3,676,117 | 7/1972 | Kinoshita | 96/1 R |
| 3,677,751 | 7/1972 | Ohta et al. | 96/1 R |
| 4,071,361 | 1/1978 | Marushima | 96/1.4 |

*Primary Examiner*—Roland E. Martin, Jr.
*Assistant Examiner*—John L. Goodrow
*Attorney, Agent, or Firm*—Fitzpatrick, Cella, Harper & Scinto

[57] ABSTRACT

A photosensitive member is exposed to light prior to primary charging so that the surface potential applied by primary charging may always be maintained at a constant level to which the photosensitive member is always charged when it is repetitively used for some time, which may be predetermined by test. Until the surface potential reaches this level, the intensity of light for pre-exposure is gradually decreased and after the surface potential has reached this level, no pre-exposure is applied. But when the surface potential rises after a predeterminable period during which the photosensitive member is not used, the pre-exposure is applied again. All the copies may have the same density.

6 Claims, 4 Drawing Figures

METHOD FOR CONTROLLING IMAGE FORMATION IN ELECTROPHOTOGRAPHY BY PRE-EXPOSURE STEP

This is a continuation of application Ser. No. 490,055, filed July 19, 1974 now abandoned which in turn is a continuation of Ser. No. 57,732 filed on July 23, 1970, now abandoned.

BACKGROUND OF THE INVENTION:

The present invention relates to an electrophotographic process and more particularly a method for controlling the image formation in an electrophotographic process so that all the copies from the first to the last copy may have the uniform density and density difference in image.

It is well known in the art of electrophotography that when a photosensitive member is exposed to light prior to the primary charging (this step will be referred to as "pre-exposure" in this specification), the surface potential charged by the primary charging is decreased as compared with that of a photosensitive member which is not subjected to the pre-exposure, so that the density of the image is decreased.

The surface potential which the photosensitive member may maintain is decreased as the number of cyclic operations is increased so that the density of the image developed is accordingly decreased. Therefore, when the photosensitive member is used repetitively for reproducing a number of copies from the same original, there is a difference in density between the first copy and the subsequent copies. That is, it is impossible to reproduce copies having the same density and density difference.

SUMMARY OF THE INVENTION

It is the primary object of the present invention to provide a method for controlling image formation in an electrophotographic process based upon the aforementioned observed results of the pre-exposure so that the density may be uniform in all copies. The present invention provides a method for controlling image formation in an electrophotographic process comprising the steps of charging, exposure, development, and image-transfer, characterized in that the whole surface of a photosensitive member is exposed to light prior to the charging step. Since the surface potential and accordingly the density of image are decreased when the surface of the photosensitive member is exposed to light for many times, the intensity of light for pre-exposure is decreased in response to the fatigue of the photosensitive member as a number of repetitive uses of the photosensitive member, that is a number of copies is increased. When the fatigue reaches the equilibrium state, the pre-exposure is not applied any longer, but when the fatigue of the photosensitive member is recovered after a "rest" period, the photosensitive member is again subjected to the pre-exposure. According to the method of the present invention, the density and density difference may become uniform in all copies.

To reduce the intensity of light for pre-exposure in response to the progress of the fatigue of the photosensitive member, the resistance in a light source circuit may be increased stepwise. As the light source for pre-exposure, a tungsten-filament lamp and fluorescent color lamp emitting light in wavelength including the intrinsic wavelengths absorbed by the photosensitive member may be used. The present invention will become more apparent from the following description of the preferred embodiment thereof taken in conjunction with the accompanying drawing.

Figure 2:
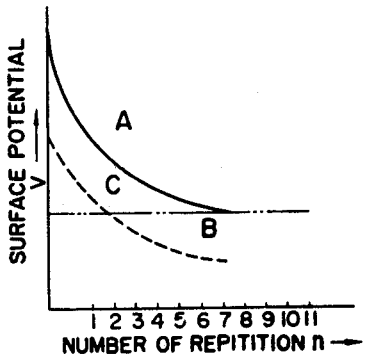
FIG. 2 is a graph showing the relationship between the surface potential and a number of repetitive uses of a photosensitive member, that is the number of copies reproduced.
Figure 3:
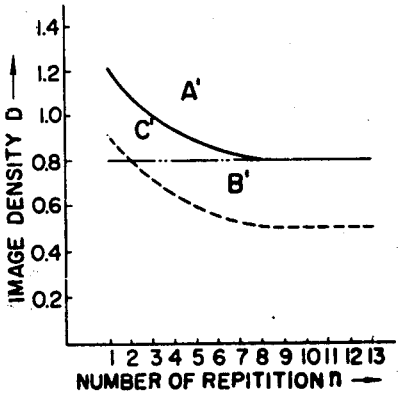
FIG. 3 is a graph showing the relationship between the density of image and a number of repetitive uses.

DESCRIPTION OF THE PREFERRED EMBODIMENT:

The preferred embodiment of the present invention will be described taken in conjunction with the accompanying drawings. The present invention contemplates to accomplish the aforementioned objects by utilizing the above-described "pre-exposure effect", and is characterized in that the whole surface of a photosensitive member is uniformly illuminated or exposed prior to the primary charging step. When the photosensitive member is always subjected to the pre-exposure with a strong intensity of light, the surface potential V of the photosensitive member is decreased as indicated by the dotted curve B in FIG. 2 while the density of the image D is reduced as indicated by the dotted curve B' in FIG. 3. Therefore, the intensity of light for pre-exposure is gradually reduced in response to the progress of the fatigue of the photosensitive member as a number of pre-exposures, that is a number of copies is increased. Alternatively, when the fatigue of the photosensitive member reaches a predetermined level, no pre-exposure will be made. In this case, the pre-exposure is given when the photosensitive member has recovered its fatigue, when the "rest" time interval during which no pre-exposure is given reaches the time required for the photosensitive member to recover. The better results are obtained. In order to gradually decrease the intensity of light for pre-exposure in response to the progress of fatigue, the resistance in the light source circuit is increased in step as one pre-exposure is made. As the light source for pre-exposure, the tungsten-filament lamp and fluorescent lamps producing colors of light will bring about better results.

Figure 1:
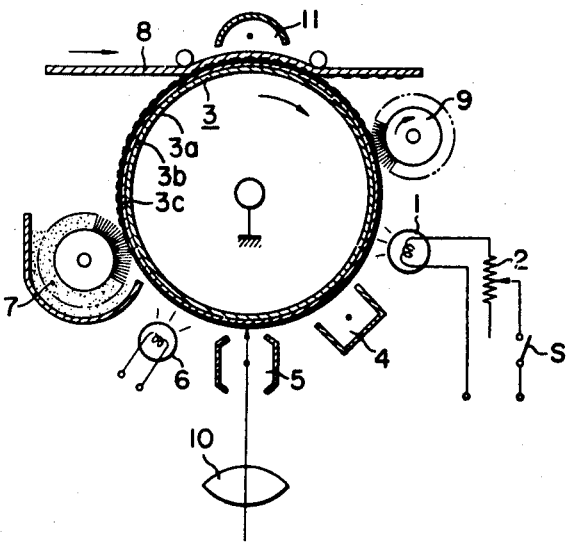
FIG. 1 is a diagrammatic view illustrating one embodiment of an electrophotographic device embodying the present invention.

In the device illustrated in FIG. 1, the intensity of light for pre-exposure is reduced in response to a degree of fatigue of the photosensitive member by increasing a value of the resistance 2 in step in the light source circuit. Therefore, a degree of fatigue of the photosensitive member due to the pre-exposure is reduced, approaching to a constant curve C in FIG. 2 so that the density of image D also approaches the horizontal curve C' in FIG. 3. Thus, a large number of copies having the same quality images may be reproduced.

Figure 4:
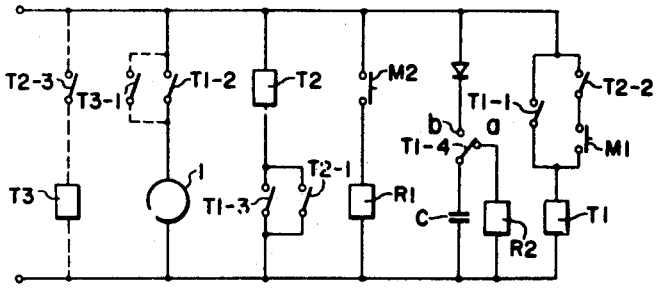
FIG. 4 is a circuit diagram of a circuit for flashing a light source in response to the progress in fatigue of the photosensitive member in accordance with the present invention.

When the photosensitive member is repetitively used for 4–50 times, the fatigue will not progress any longer (In the graph of FIG. 2, at the seventh time) so that the switch S is opened so as to disconnect the lamp from its power source. When the photosensitive member is not used for a rest time (one minute to one hour), it may recover to about 90% of its initial condition prior to the first pre-exposure. Therefore, the tests are made in order to determine a number of repetitive uses of the photosensitive member at which the fatigue reaches a constant value, that is the fatigue is in equilibrium and a rest time interval during which the photosensitive member may recover its fatigue. According to the results of the test the lamp for pre-exposure may be automatically turned on and off so that better results may be obtained. FIG. 4 depicts an automatic flashing circuit for a lamp for pre-exposure in which a microswitch M1 is immediately turned on when copying operation is started and is instantaneously turned off. When the microswitch M1 is closed, a timer T1 is started. For example a timer measuring one minute is started and during this timer interval the contacts T1-1, T1-2 and T1-3 of the timer T1 are closed while the contact T1-4 is switched to the contact b, so that the timer T1 is held by itself, the lamp 1 is turned on, the timer T2 is actuated and the capacitor C is charged.

The timer T2 is actuated for one minute as in the case of the timer T1 and is held in operative position by contact T2-1. Since the contact T2-2 is opened when the timer T2 is actuated, the latter is independent of the microswitch M1. The microswitch M2 is closed simultaneously or more or less later than when the microswitch M1 is closed so that the relay R1 is actuated so as to reset the timer T2. More particularly in case of continuous photocopying operation, the lamp 1 remains turned on by the timer T1 for one minute and remains turned off for one minute by the timer T2 after the last copy is produced. When only one copy is reproduced, the timer T1 is stopped after one minute so that the contacts T1-1, T1-2 and T1-3 are opened while the contact T1-4 is switched to the contact a. Therefore the capacitor C is discharged so that the relay R2 is actuated, thereby setting the timer T2. Then, the timer T2 is actuated for one minute and during this time, the lamp 1 remains turned off. That is, when the copying operation is made within one hour, the relay R1 is actuated by the microswitch M2, thus resetting the timer T2. On the other hand, since the contact T2-2 is opened, the timer T1 is not actuated so that the lamp 1 remains turned off for the next one minute. When the copying operation is made after the time set by the timer T2, the current flows into the timer T1 through the contact T2-2 and microswitch M1 because the timer T2 is deactuated. The contact T1-2 is closed by the timer T1, thereby turning the lamp 1. The circuits depicted by the dotted lines is used when the photocopying operation is not continued for a long time. More particularly, the contact T3-1 is turned on and off at a time interval of one minute so as to flash the lamp 1 independently of the timers T1 and T2. When the timer is operating, the timer T3 is not actuated because the contact T2-3 is opened by the timer T2. The circuit for charging and discharging a capacitor or transistor circuit may be employed as the circuit for actuating the timers T1, T2 and T3. The time-intervals set by the timers T1, T2 and T3 may be arbitarily selected depending upon the characteristics of the photosensitive member used.

Referring back to FIG. 1, a photosensitive member 3 in the form of a drum consists of a support layer 3*a*, a photoconductive layer 3*b* and an insulating layer 3*c*, and around the rotary photosensitive drum 3 are disposed a primary charger 4, a light image projection station 5 where a light image is projected upon the drum 3 contemporaneously when the secondary charge is imparted thereto or the charge on the drum is discharged; means 6 for illuminating the whole surface of the drum 3, developing means 7; a recording medium 8 to which is transferred the image; cleaning means 9, a projection lens 10 and a bias electrode 11 used when the image is transferred. The CdS photosensitive member was used in such a manner that the intensity of light is linearly decreased from 1,000 lux at the first photocopying operation to 10 lux at the tenth operation. In this case, the copies having the images in uniform density were obtained.

When the pre-exposure was given at 100 lux to the CdS photosensitive member and no pre-exposure was given from the second to tenth operation, the copies having the images in uniform density were produced.

What is claimed is:

1. In a repetitive electrophotographic process including the steps of applying a primary charge of a predetermined polarity to a reusable photosensitive member having a photoconductive layer and an overlying insulating surface layer; discharging or applying a secondary charge having a component of a polarity opposite to said predetermined polarity to the photosensitive member, and substantially simultaneously therewith, exposing the photosensitive member to imaging light; then uniformly exposing the surface of the photosensitive member to light to form an electrostatic latent image on the photosensitive member; thereafter utilizing the electrostatic latent image; and thereafter sequentially repeating the process steps using the photosensitive member to form and utilize a plurality of electrostatic latent images, the improvement comprising the steps of:

uniformly applying light to the surface of the photosensitive member which is to be exposed to the image light at least before initiation of the application of primary charge to the photosensitive member for a first image formation in a continuous sequence of image forming operations; and uniformly applying light of an intensity lower than that of the initial uniform light application to said surface of the photosensitive member before the initiation of primary charge application for a subsequent image formation in the sequence of image forming operations.

2. A method according to claim 1, wherein the light applied before the first set of latent image forming and utilizing steps is applied before each of a plurality of said sets of steps, and wherein the intensity of the light decreases with each application in accordance with the fatigue characteristics of the photosensitive member.

3. A method according to claim 2, further comprising the step of interrupting the application of light before the initiation of additional latent image forming and utilizing steps once the fatigue of the photosensitive member reaches an equilibrium state.

4. In an electrophotographic machine including a reusable photosensitive member having a photoconductive layer and an overlying insulating surface layer; means for supporting said photosensitive member for endless movement; means for applying a primary charge of a predetermined polarity to said photosensitive member; means for exposing said photosensitive member to imaging light after the application of the primary charge; means for discharging or applying a secondary charge having a component of a polarity opposite to said predetermined polarity to said photosensitive member substantially simultaneously with exposure of said photosensitive member to imaging light by said imaging light exposing means; means for uniformly exposing the surface of said photosensitive member to light after the image light exposure to form an electrostatic latent image on said photosensitive member; means for utilizing the electrostatic latent image formed on the surface of said photosensitive member; and means for preparing the surface of said photosensitive member for repetitive use after the electronic latent image is utilized, the improvement comprising:

image density adjusting means for causing fatigue of the photoconductive layer of said photosensitive member by applying light thereto so as to adjust image density, wherein said image density adjusting means uniformly applies light of a predetermined intensity to said photosensitive member, when said primary charge applying means, imaging light exposure means, discharging means, uniform exposure means, utilizing means and preparing means are to be repeatedly operated in sequence to form and utilize a plurality of electrostatic latent images, prior to the first application of primary charge during the sequential operation and applies uniform light of an intensity lower than said predetermined intensity prior to a subsequent application of primary charge during the sequence of image forming operations.

5. An electrophotographic machine according to claim 4, wherein said image density adjusting means applies light before each of a plurality of primary charge applications during sequential operation and includes means to reduce the intensity of the light applied thereby in accordance with the fatigue characteristics of said photoconductive layer.

6. An electrophotographic machine according to claim 5, wherein said reducing means terminates the application of light by said image density adjusting means after the fatigue of said photoconductive layer reaches an equilibrium level.

* * * * *